US007187251B2

(12) United States Patent
Chirala et al.

(10) Patent No.: US 7,187,251 B2
(45) Date of Patent: Mar. 6, 2007

(54) DC ISOLATED PHASE INVERTER AND A RING HYBRID COUPLER INCLUDING THE DC ISOLATED PHASE INVERTER

(75) Inventors: Mohan K. Chirala, College Station, TX (US); Brian A. Floyd, Cortlandt Manor, NY (US); Thomas M. Zwick, Kisslegg (DE)

(73) Assignee: International Business Machines Corporation, Armonk, NY (US)

( * ) Notice: Subject to any disclaimer, the term of this patent is extended or adjusted under 35 U.S.C. 154(b) by 170 days.

(21) Appl. No.: 11/081,237

(22) Filed: Mar. 16, 2005

(65) Prior Publication Data

US 2006/0208828 A1 Sep. 21, 2006

(51) Int. Cl.
*H01P 5/12* (2006.01)
*H01P 5/22* (2006.01)

(52) U.S. Cl. ..... 333/120; 333/154; 333/161

(58) Field of Classification Search ..... 333/109, 333/116, 117, 118, 120, 1, 156, 161
See application file for complete search history.

(56) References Cited

U.S. PATENT DOCUMENTS 4,316,160 A * 2/1982 Dydyk ..... 333/120
5,107,223 A * 4/1992 Sakai et al. ..... 330/122
6,374,017 B1 * 4/2002 Romaniuk ..... 385/39
6,778,037 B1 * 8/2004 Salmela et al. ..... 333/109
2004/0061571 A1 * 4/2004 Pozdeev ..... 333/117

OTHER PUBLICATIONS

Steven March, "A Wideband Stripline Hybrid Ring", IEEE Transactions on Microwave Theory and Techniques, Jun. 1968, p. 361.
Wang et al., "Size-Reduction and Band-Broadening Design Technique of Uniplanar Hybrid Ring Coupler Using Phase Inverter for M(H)MIC's", IEEE Transactions on Microwave Theory and Techniques, vol. 47, No. 2, Feb. 1999, pp. 198-206.
Fan et al., "Wide-Band Reduced-Size Uniplanar Magic-T, Hybrid-Ring, and de Ronde's CPW-Slot Couplers", IEEE Transactions on Microwave Theory and Techniques, vol. 43, No. 12, Dec. 1995, pp. 2749-2758.

(Continued)

*Primary Examiner*—Robert Pascal
*Assistant Examiner*—Kimberly E. Glenn
(74) *Attorney, Agent, or Firm*—F. Chau & Associates LLC

(57) ABSTRACT

A direct current (DC) isolated phase inverter and a ring hybrid coupler including the DC isolated phase inverter is provided. The ring hybrid coupler including the DC isolated phase inverter comprising: a first, second, third and fourth transmission line arm; a first port connected to the first arm, second port connected to the second arm, third port connected to the third arm and fourth port connected to the fourth arm; and a DC phase inverter inserted within one of the first, second, third and fourth arms, wherein the DC phase inverter comprises: a transmission line comprising a plurality of signal and ground traces, wherein the plurality of signal and ground traces are interchanged; and a plurality of capacitors disposed in series with the ground traces, wherein the plurality of capacitors isolate the DC phase inverter from a device connected to the transmission line.

24 Claims, 15 Drawing Sheets

OTHER PUBLICATIONS

Change et al., "A Novel Broad-Band Chebyshev-Response Rat-Race Ring Coupler", IEEE Transactions on Microwave Theory and Techniques, vol. 47, No. 4, Apr. 1999, pp. 455-462.

Eccleston et al., "Compact Planar Microstripline Branch-Line and Rat-Race Couplers", IEEE Transactions on Microwave Theory and Techniques, vol. 51, No. 10, Oct. 2003, pp. 2119-2125.

S. March, "A wideband stripline hybrid ring," IEEE Trans. Microwave Theory Tech., vol. MTT-16, pp. 361, Jun. 1968.

K.W. Eccleston and S.H.M. Ong, "Compact planar microstripline branch-line and rat-race couplers," IEEE. Trans. Microwave Theory Tech., vol. 51, No. 10, pp. 2119-2125, Oct. 2003.

T.Wang and K. Wu, "Size-reduction and band-broadening design technique of uniplanar hybrid ring coupler using phase inverter for M(H)MIC's," IEEE Trans. Microwave Theory Tech., vol. 47, No. 2, pp. 198-206, Feb. 1999.

* cited by examiner (a)

(b)

(c)

| | T-line | T-line w/ Phase Inverter | T-line w/ DC Isolated Phase Inverter |
|---|---|---|---|
| Length | 210 μm | 210 μm | 210 μm |
| Zo | 47 Ω | 47 Ω | 47 Ω |
| Alpha | 0.9 dB/mm | — | — |
| Lambda | 2.4 mm | — | — |
| Mag-$S_{21}$ | -0.18 dB | -0.2 dB | -0.29 dB |
| Phase-$S_{21}$ | -31° | 144° | 144.8° |

FIG. 5

| | Ring Hybrid, no capacitors | Ring Hybrid, with capacitors |
|---|---|---|
| Coupling | -3.6 to -4.2 dB | -3.9 dB |
| Isolation | -30 dB | -38 dB |
| Return Loss | -22dB | -25 dB |

FIG. 11

DC ISOLATED PHASE INVERTER AND A RING HYBRID COUPLER INCLUDING THE DC ISOLATED PHASE INVERTER

BACKGROUND OF THE INVENTION

1. Technical Field

The present invention relates to communications systems, and more particularly, to millimeter-wave transmission lines and hybrid couplers.

2. Discussion of the Related Art

A conventional building block for use in high-frequency circuits such as radio frequency (RF) or millimeter-wave circuits is a ring hybrid or "rat-race" coupler. The ring hybrid or "rat race" coupler is a four-port device that is used as a power combiner or splitter in a variety of applications such as balanced amplification and mixing, differential clock or local-oscillator signal generation, and power combining. A conventional four-port ring hybrid coupler 110 having a microstrip transmission line is shown in FIG. 1A.

As shown in FIG. 1A, the circumference of the ring hybrid coupler 110 is $6\lambda/4$, where $\lambda$ is the wavelength that defines the center frequency of the operation of the ring hybrid coupler 110. Typically, the ring hybrid coupler 110 is designed to have an equal, for example, 3 dB power split, thus requiring the impedance of the ring hybrid coupler 110 to be two times the characteristic impedance of its ports. When a signal is incident on port 3 (e.g., 3, $\Sigma$), the signal's power is equally split between ports 2 (e.g., 2, P) and 4 (e.g., 4, N) with no power exiting port 1 (e.g., 1, $\Delta$) or reflecting back to port 3. In this case, the signals at ports 2 and 4 are in phase; hence, port 3 is referred to as a common-mode, sum, or $\Sigma$ port. When a signal is incident on port 1, its power is again equally split between ports 2 and 4 with no power exiting port 3 or reflecting back to port 1. In this case, the signals at ports 2 and 4 are now out of phase; hence, port 1 is referred to as the differential, difference, or $\Delta$ port.

Many techniques have been proposed to reduce the size of a ring hybrid coupler. These techniques include, for example, replacing the $3\lambda/4$ section or arm by a $\lambda/4$ coupled-line section, replacing the $3\lambda/4$ section with a lumped-element circuit, or using slow-wave transmission lines to reduce the wavelength of a propagating signal. Another technique for reducing the size of a ring hybrid coupler involves inserting a phase inverter in the $3\lambda/4$ arm. An example of this technique is shown in FIG. 1B with a ring hybrid coupler 120 using a finite-ground coplanar waveguide (FGCPW) 160.

As shown in FIG. 1B, a phase inverter 130 is used to exchange ground 140*a–d* and signal 150*a–b* traces in a transmission line thus providing a 180-degree phase shift. This configuration reduces the length of the $3\lambda/4$ arm to $\lambda/4$. By representing the $\lambda/4$ arm by a phase shift $\theta$, the length of all arms of a ring hybrid can be further reduced by acknowledging that $\theta$ does not have to be 90 degrees. This will lead to a ring hybrid having a smaller circumference with a reduced bandwidth. The matching criterion for an arbitrary $\theta$ in FIG. 1B is given by equation (1):

$$Z=Zo.[2(1-\cot^2\theta)]^{0.5} \quad (1)$$

where Z is arm or ring impedance and Zo is port impedance.

FIG. 2A illustrates the phase inverter 130 in more detail. As shown in FIG. 2A, the phase inverter 130 includes the ground traces 140*a–d*, input signal trace 150*a* and phase-inverted signal trace 150*b*. In operation, the phase inverter 130 receives an input signal via the input signal trace 150*a* and provides an output signal via the phase-inverted signal trace 150*b* that is 180-degrees out of phase with the input signal.

Due to inserting a phase inverter in a ring hybrid coupler, the size of ring hybrid coupler is reduced. In addition, phase inverters can be inserted in a circuit where a 180-degree phase shift is needed, thus forcing a direct current (DC) ground onto signal lines of a ring hybrid. As a result, DC blocking capacitors are required in circuits connected to the phase inverter and in the case of the ring hybrid having a basic phase inverter all four ports of the ring hybrid are DC grounded thereby preventing the common-mode port from feeding DC signals into the ring hybrid coupler.

Although it may be advantageous to feed a DC signal into a ring hybrid coupler through its common-mode port when a common-mode biased differential amplifier employing a "rat-race" as a balun at its inputs and outputs is used, the conventional phase inverter configuration precludes this by requiring the use of blocking capacitors and feed resistors.

SUMMARY OF THE INVENTION

The present invention overcomes the foregoing and other problems encountered in the known teachings by providing a direct current (DC) isolated phase inverter that uses DC blocking capacitors inserted in ground or signal traces of the transmission line of the DC isolated phase inverter. The present invention overcomes the foregoing and other problems encountered in the known teachings by also providing a ring hybrid coupler including the DC isolated phase inverter.

In one embodiment of the present invention, a DC phase inverter comprises: a transmission line comprising a plurality of signal and ground traces, wherein the plurality of signal and ground traces are interchanged; and a plurality of capacitors disposed in series with the plurality of ground traces, wherein the plurality of capacitors isolate the DC phase inverter from a device connected to the transmission line.

The transmission line is one of a finite-ground coplanar waveguide (FGCPW), coplanar waveguide, coplanar stripline, microstrip and slotline. The transmission line is capable of one of millimeter wave transmission and microwave transmission. The plurality of capacitors are one of metal-insulator-metal (MIM) capacitors, vertical parallel-plate capacitors, fringe capacitors, polysilicon capacitors and metal-oxide semiconductor (MOS) capacitors.

The device connected to the transmission line is one of an amplifier, mixer, voltage-controlled oscillator (VCO), filter, frequency divider, frequency multiplier, limiter and hybrid coupler. The plurality of signal traces comprise an input signal trace and phase-inverted signal trace. A signal input via the input signal trace is shifted 180-degrees and output via the phase-inverted signal trace.

In another embodiment of the present invention, a ring hybrid coupler comprises: a first, second, third and fourth transmission line arm; a first port connected to the first arm, second port connected to the second arm, third port connected to the third arm and fourth port connected to the fourth arm; and a DC phase inverter inserted within one of the first, second, third and fourth arms, wherein the DC phase inverter comprises: a transmission line comprising a plurality of signal and ground traces, wherein the plurality of signal and ground traces are interchanged; and a plurality of capacitors disposed in series with the plurality of ground traces, wherein the plurality of capacitors isolate the DC phase inverter from a device connected to the transmission line.

The first, second, third and fourth transmission line arms have equal lengths, wherein the lengths of the first, second, third and fourth transmission lines are 50 μm to 10 mm. The impedance of one of the first, second, third and fourth transmission line arms is determined by: $Z=Zo.[2(1-\cot^2\theta)]^{0.5}$ where Z is the impedance of one of the first, second, third and fourth transmission line arms and Zo is impedance of one of the first, second, third and fourth ports.

The DC phase inverter performs a 180-degree phase shift through the interchange between the signal and ground traces. One of the first, second, third and fourth ports is a common-mode port. The DC phase inverter is inserted within one of the first, second, third and fourth arms not adjacent to the common-mode port. The DC phase inverter restores DC operation of the common-mode port while leaving the remaining ports at a common-mode potential applied to the common-mode port.

The transmission line of the DC phase inverter is one of a FGCPW, coplanar waveguide, coplanar stripline, microstrip and slotline. The transmission line of the DC phase inverter is capable of one of millimeter wave transmission and microwave transmission. The capacitors of the DC phase inverter are one of MIM capacitors, vertical parallel-plate capacitors, fringe capacitors, polysilicon capacitors and MOS capacitors.

The device connected to the DC phase inverter is one of an amplifier, mixer, VCO, filter, frequency divider, frequency multiplier, limiter and hybrid coupler. The plurality of signal traces of the DC phase inverter comprise an input signal trace and phase-inverted signal trace. A signal input via the input signal trance is shifted 180-degrees and output via the phase-inverted trace.

In yet another embodiment of the present invention, a method for isolating a DC phase inverter comprises: interchanging a plurality of signal and ground traces on a transmission line of the DC phase inverter; and isolating the DC phase inverter from a device connected to the transmission line by inserting a plurality of capacitors in series with the plurality of ground traces. A signal input via an input signal trace of the plurality of signal traces is shifted 180-degrees and output via a phase-inverted signal trace of the plurality of signal traces. The method further comprises: inserting the DC phase inverter into an arm of a ring hybrid coupler and restoring DC operation of a common-mode port of the ring hybrid coupler while leaving remaining ports of the ring hybrid coupler at a common-mode potential applied to the common-mode port.

The foregoing features are of representative embodiments and are presented to assist in understanding the invention. It should be understood that they are not intended to be considered limitations on the invention as defined by the claims, or limitations on equivalents to the claims. Therefore, this summary of features should not be considered dispositive in determining equivalents. Additional features of the invention will become apparent in the following description, from the drawings and from the claims.

BRIEF DESCRIPTION OF THE DRAWINGS

FIG. 5 is a table illustrating a simulated performance of a transmission line with and without using phase inverters;

FIG. 11 is a table illustrating a comparison of the ring hybrid of FIG. 6 with and without alternating current (AC) coupling capacitors.

DETAILED DESCRIPTION OF EXEMPLARY EMBODIMENTS

Figure 1A:
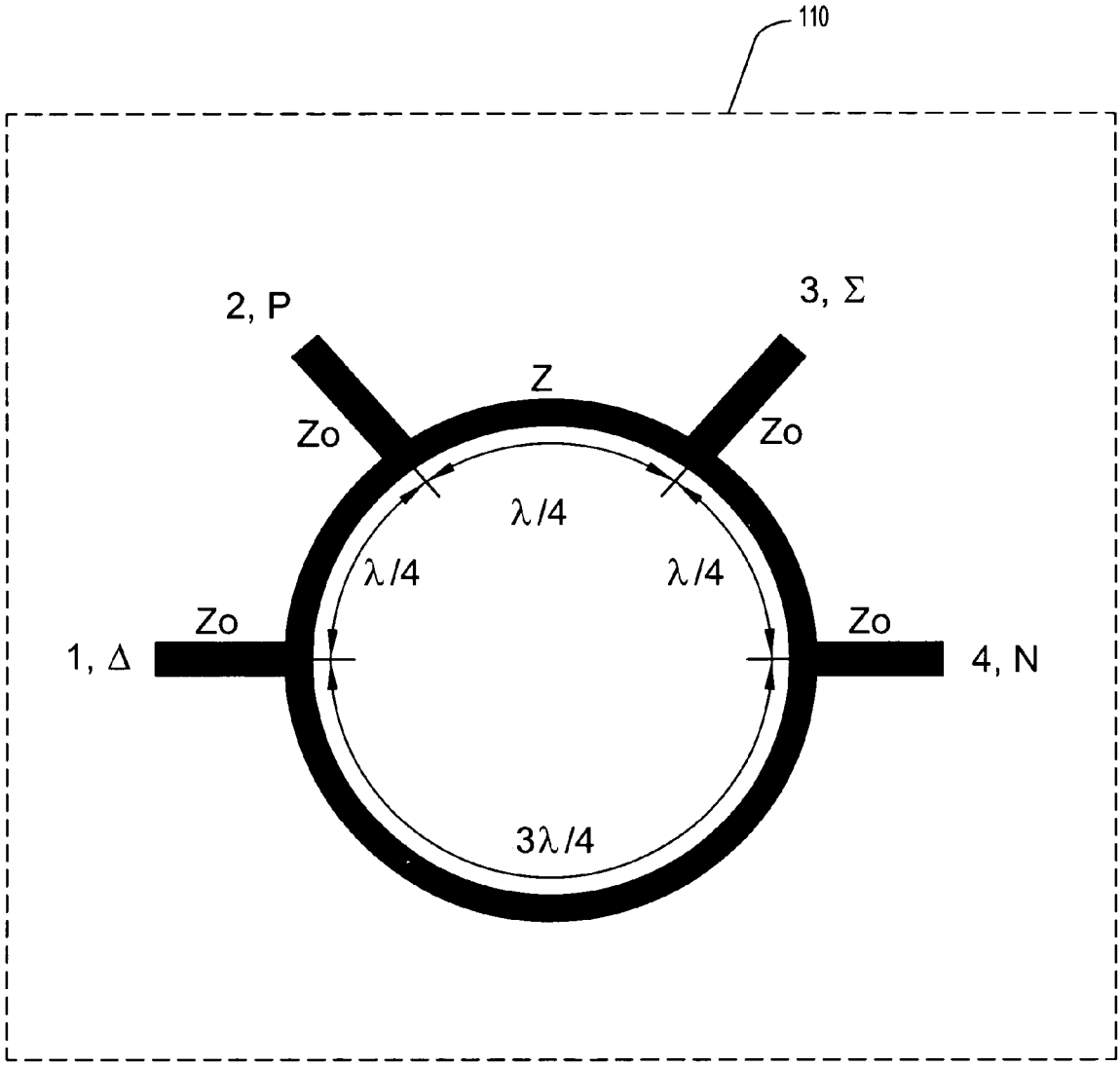
FIG. 1A is a diagram of a conventional ring hybrid or "rat race" coupler having a microstrip transmission line.
Figure 1B:
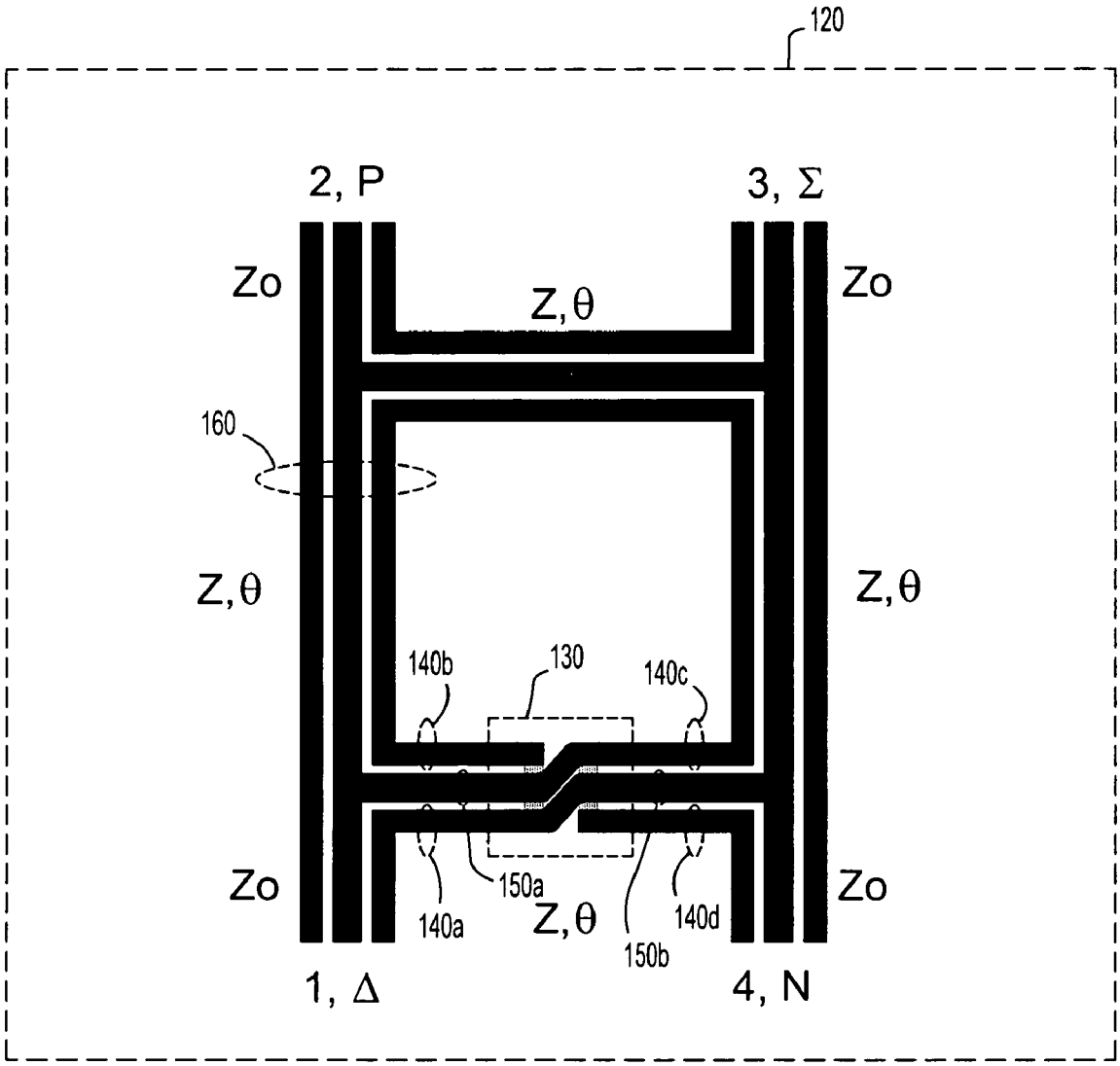
FIG. 1B is a diagram of a conventional reduced-size ring hybrid or "rat race" coupler having a finite-ground coplanar waveguide (FGCPW)
Figure 2A:
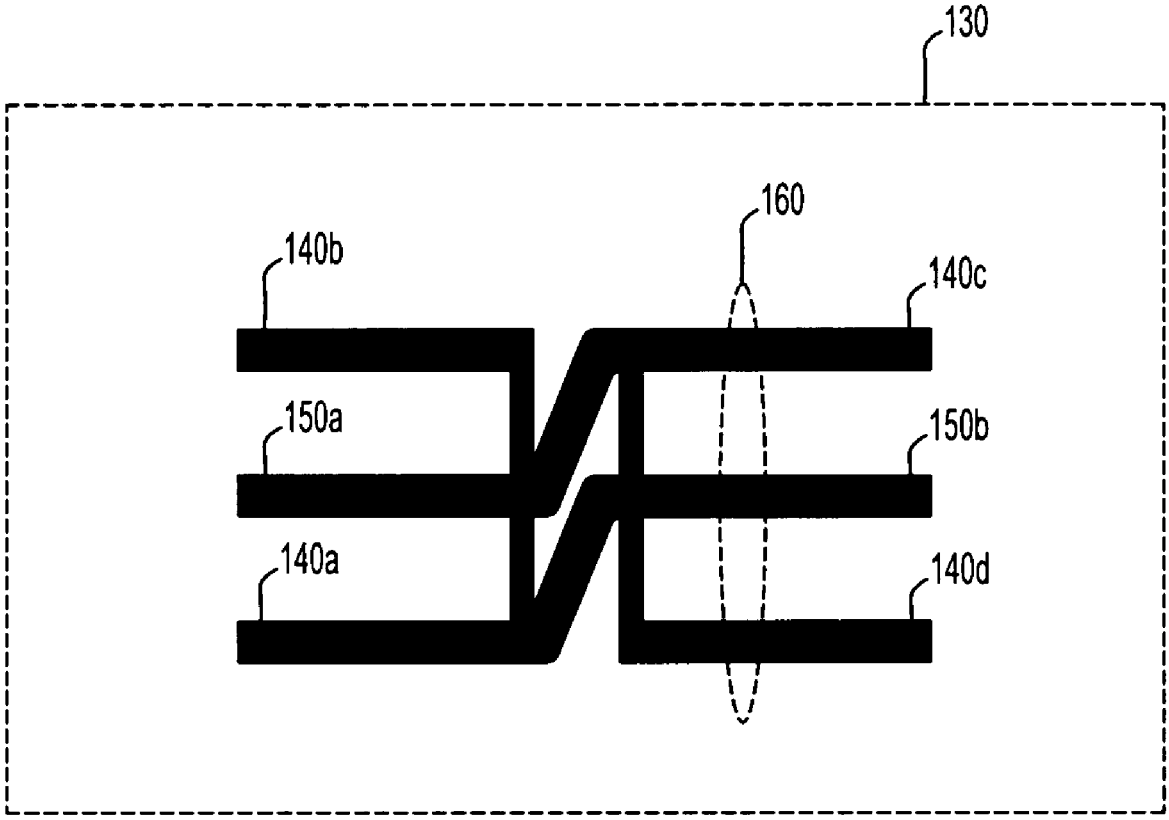
FIG. 2A is a diagram of a conventional phase inverter.
Figure 2B:
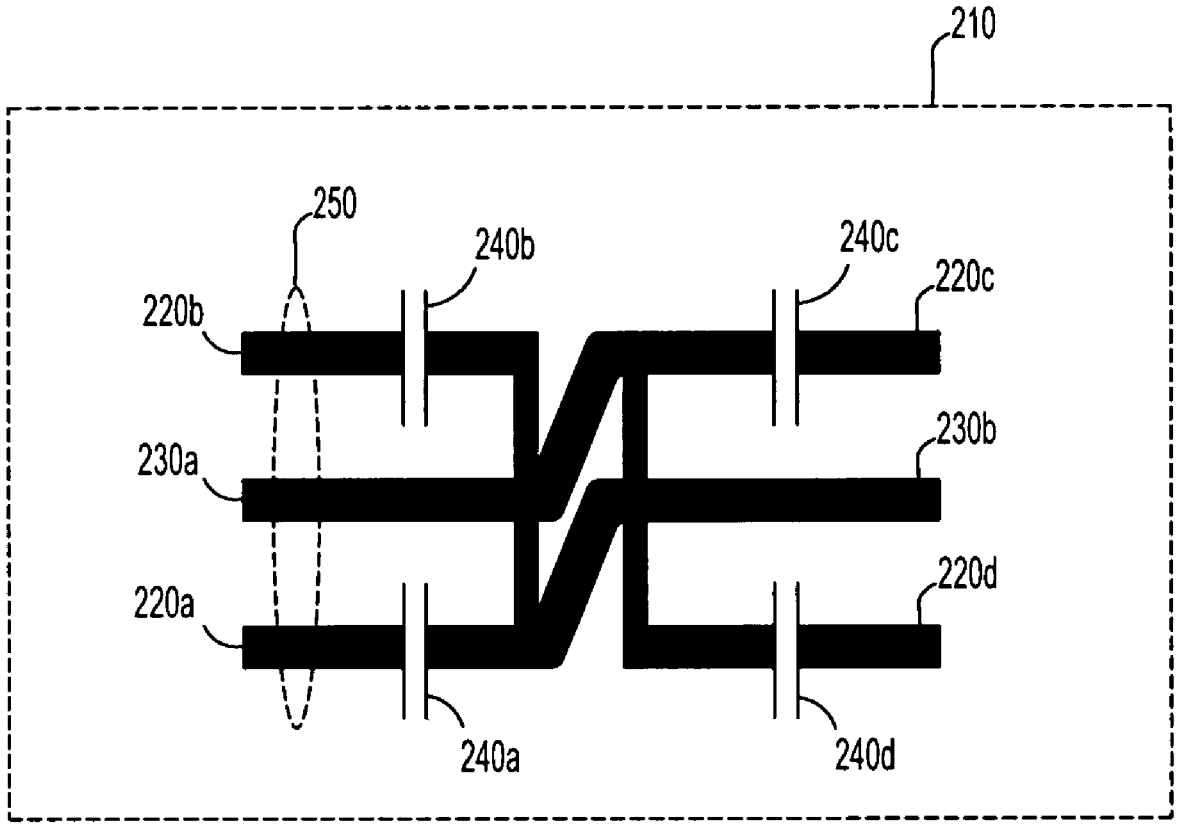
FIG. 2B is a diagram of a direct current (DC) isolated phase inverter including a FGCPW according to an exemplary embodiment of the present invention.

FIG. 2B illustrates a direct current (DC) isolated phase inverter 210 including a finite-ground coplanar waveguide (FGCPW) transmission line 250 according to an exemplary embodiment of the present invention. As shown in FIG. 2B, the DC isolated phase inverter 210 includes several ground traces 220*a–d* interchanged with an input signal trace 230*a* and a phase-inverted signal trace 230*b*. The DC isolated phase inverter 210 also includes several capacitors 240*a–d* inserted in series in the ground traces 220*a–d*. The DC isolated phase inverter 210 may include coplanar waveguide, coplanar stripline, microstrip and slotline transmission lines in place of the FGCPW transmission line 250 all of which are capable of millimeter wave and microwave transmission.

Figure 3:
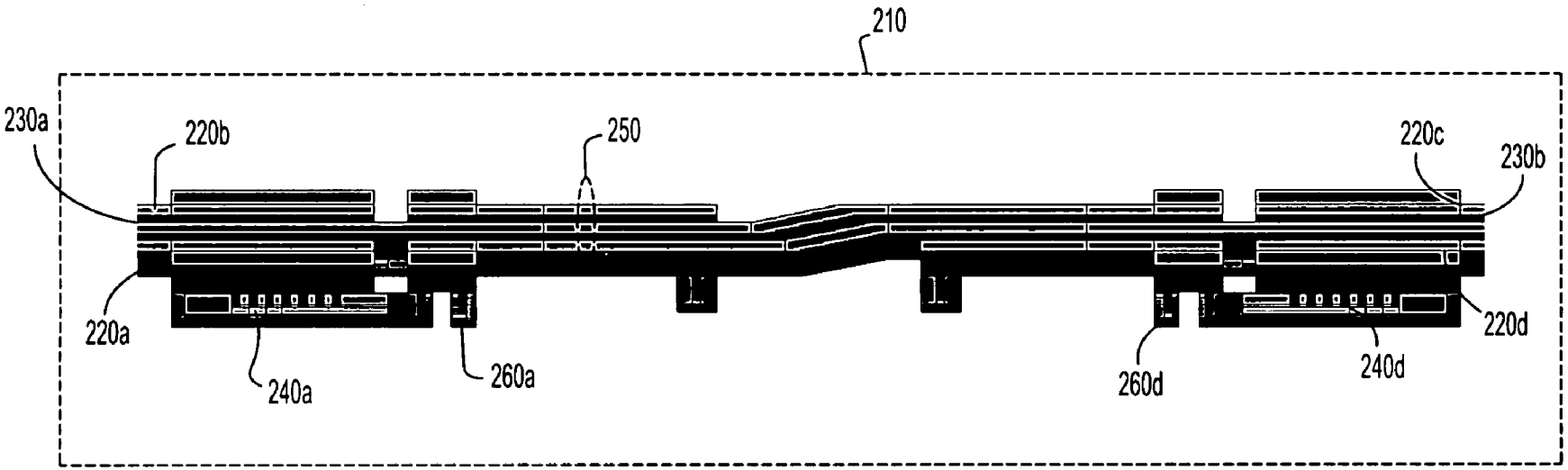
FIG. 3 is a layout of the DC isolated phase inverter of FIG. 2B.

FIG. 3 is a layout of the DC isolated phase inverter 210. Although the DC isolated phase inverter 210 of FIG. 2 includes four capacitors 240*a–d*, only two capacitors 240*a,d* are shown in FIG. 3 for illustrative purposes. As shown in FIG. 3, metal-insulator-metal (MIM) capacitors having a capacitance density of, for example, 1 fF/μm are used. However, other types of capacitors such as vertical parallel-plate capacitors, fringe capacitors, polysilicon capacitors and metal-oxide semiconductor (MOS) capacitors having similar densities may also be used in accordance with the present invention. The capacitors for use with the present invention are chosen such that they fit easily into the transmission line 250 structure of the DC isolated phase inverter 210 while having a large enough capacitance to not degrade radio frequency (RF) operation of the DC isolated phase inverter 210.

As further shown in FIG. 3, two vias 260*a,d* are included in the DC isolated phase inverter 210 to attach the capacitors 240*a,d* implemented in lower-level metal to the transmission line 250 implemented in top-level metal. The vias 260*a,d* are used to move from the top-level of the FGCPW 250 down to the top-plate of the capacitors 240*a,d* and then from the bottom-plate of the capacitors 240*a,d* back to top-level of the FGCPW 250. In this configuration, the DC isolated phase inverter 210 is capable of receiving a signal input via the input signal trace 230*a* and providing an output signal via the phase-inverted signal trace 230*b* that is 180-degrees out of phase with the input signal. In addition, the DC isolated phase inverter 210 functions as a blocking capacitor at DC by isolating it from devices that it may be connected thereto. Such devices may be, for example, an amplifier, mixer, voltage-controlled oscillator (VCO), filter, frequency divider, frequency multiplier, limiter and hybrid coupler.

Figure 4A:
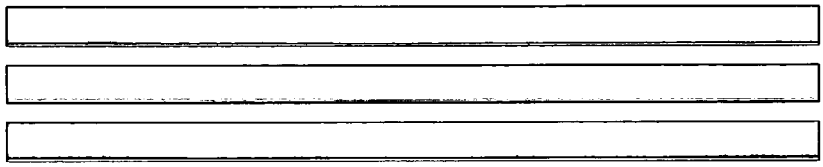
FIG. 4A is a set of layouts for a FGCPW, a phase-inverted FGCPW and the DC isolated phase inverter of FIG. 2B.
Figure 4A:
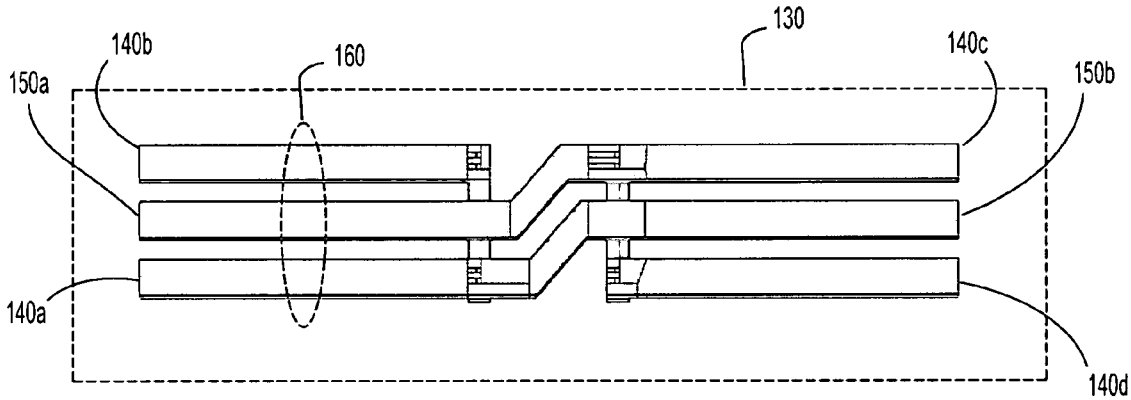
Figure 4A:
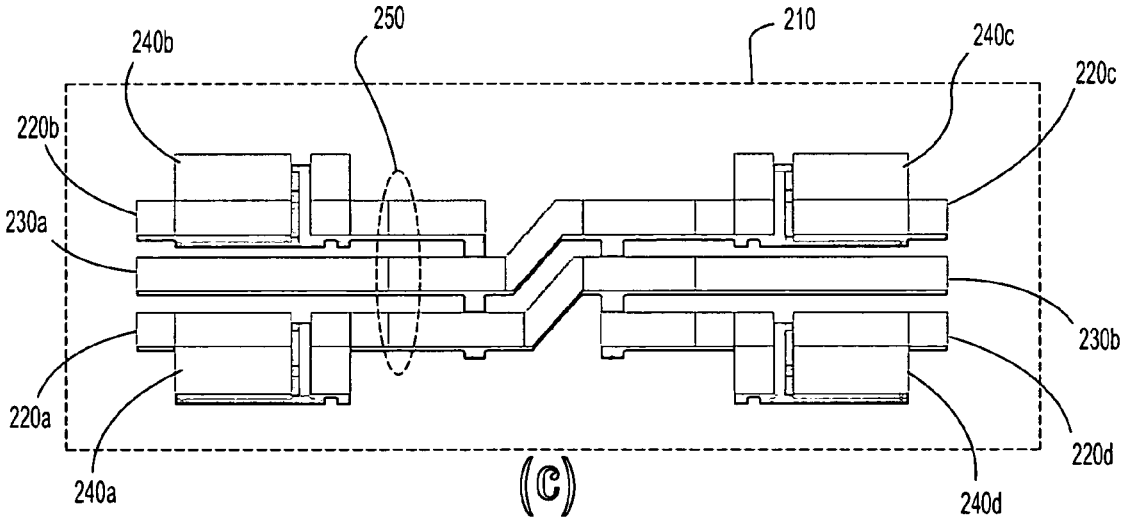
Figure 4B:
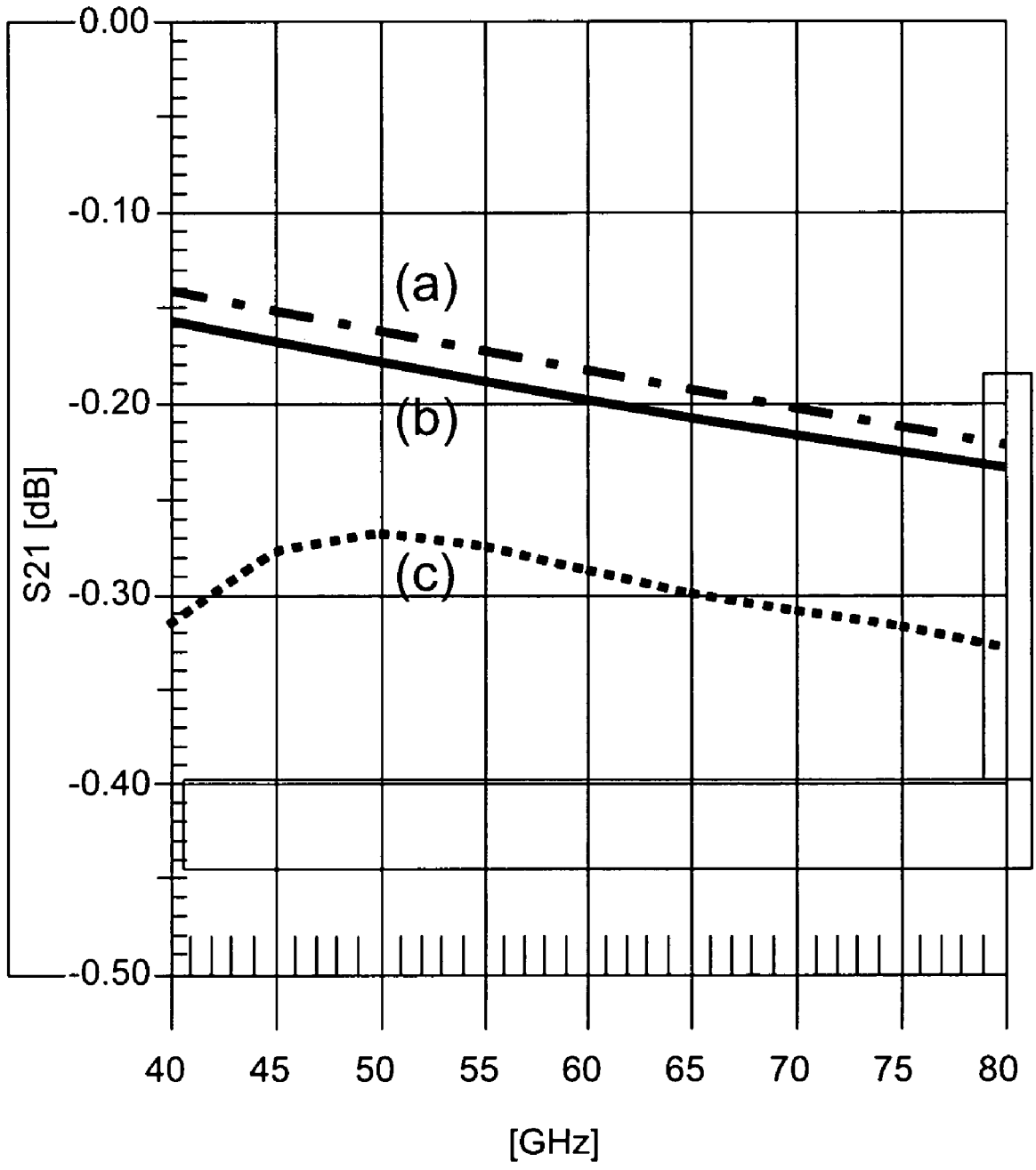
FIG. 4B is a graph illustrating simulated insertion losses of the FGCPW, the phase-inverted FGCPW and the DC isolated phase inverter of FIG. 4B.

Simulations were performed on the DC isolated phase inverter 210 using a 2.5 dimensional method-of-moments based simulator on an FGCPW transmission line (a), an FGCPW transmission line 160 with the phase inverter 130 (*b*), and an FGCPW transmission line 250 with the DC isolated phase inverter 210 (*c*). These devices are shown in FIG. 4A and their corresponding simulated insertion losses, e.g., simulated $S_{21s}$, are shown in FIG. 4B. The devices of FIG. 4A were all implemented with an FGCPW transmission line having a characteristic impedance of 46 ohms and the simulated performance of the devices is presented in table format in FIG. 5.

As shown in FIG. 5, the conventional 210 μm transmission line (a) has a −0.18 dB loss and a −31 degree phase sift. The transmission line 160 with the conventional phase inverter 130 (*b*) has a −0.2 dB loss and a 175 degree (i.e., (−31)−144=175) phase shift. The transmission line 250 with the DC isolated phase inverter 210 (*c*) has a −0.29 dB loss while maintaining approximately the same phase shift (i.e., (−31)−144.8=175.8) as the conventional phase inverter 130 (*b*). This demonstrates that the DC isolated phase inverter 210 works as well as a conventional phase inverter 130 over a broad range of frequencies.

Figure 6:
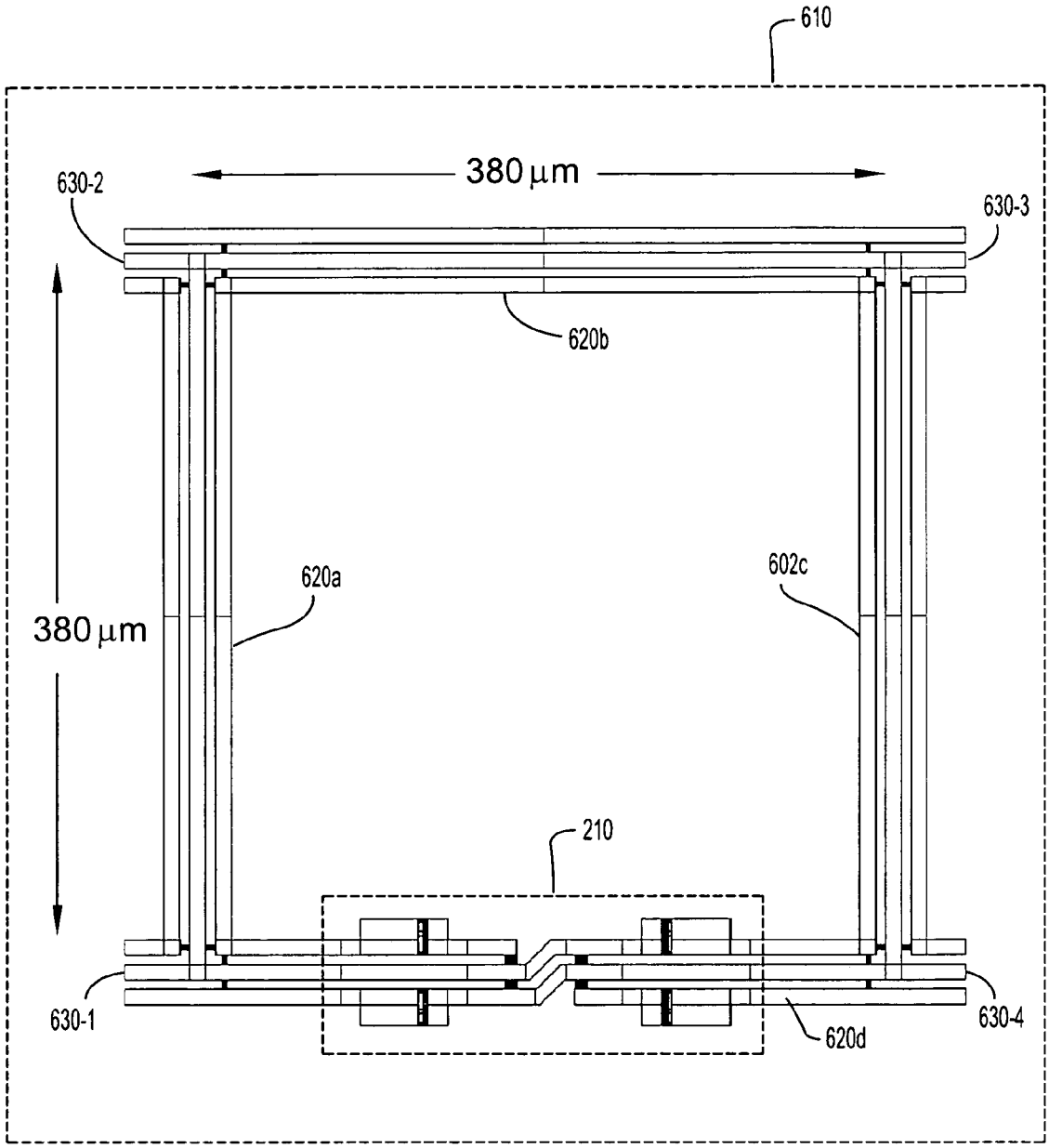
FIG. 6 is a layout of a ring hybrid including the DC isolated phase inverter of FIG. 2B according to another exemplary embodiment of the present invention.

FIG. 6 is a layout of a ring hybrid 610 including the DC isolated phase inverter 210 according to another exemplary embodiment of the present invention. As shown in FIG. 6, the ring hybrid 610 includes four arms 620*a–d*, four ports 630-1–4 and the DC isolated phase inverter 210 on arm 620*d*. In this configuration, port 630-1 is a differential (i.e., Δ) port, port 630-2 is a positive (i.e., P) port, port 630-3 is a common-mode (i.e., Σ) port and port 630-4 is a negative (i.e., N) port. The length of each of the arms 620*a–d* is 380 μm. This corresponds to approximately λ/6 at 60 GHz where λ is 600 μm at 60 GHz.

It is to be understood that the arm lengths of the ring hybrid 610 can vary depending on the desired frequency of operation. For integrated designs, these lengths could range from 50 μm to 10 mm, thus enabling operation in the frequency range from 400 GHz to 2 GHz, respectively. It should also be understood that the DC isolated phase inverter 210 could placed on any of the four arms 620*a–d*; however, when the DC isolated phase inverter 210 is placed on an arm other than arm 620*d*, the identification (e.g., Δ, P, N, and Σ) of the ports 630-1–4 would change.

Figure 7:
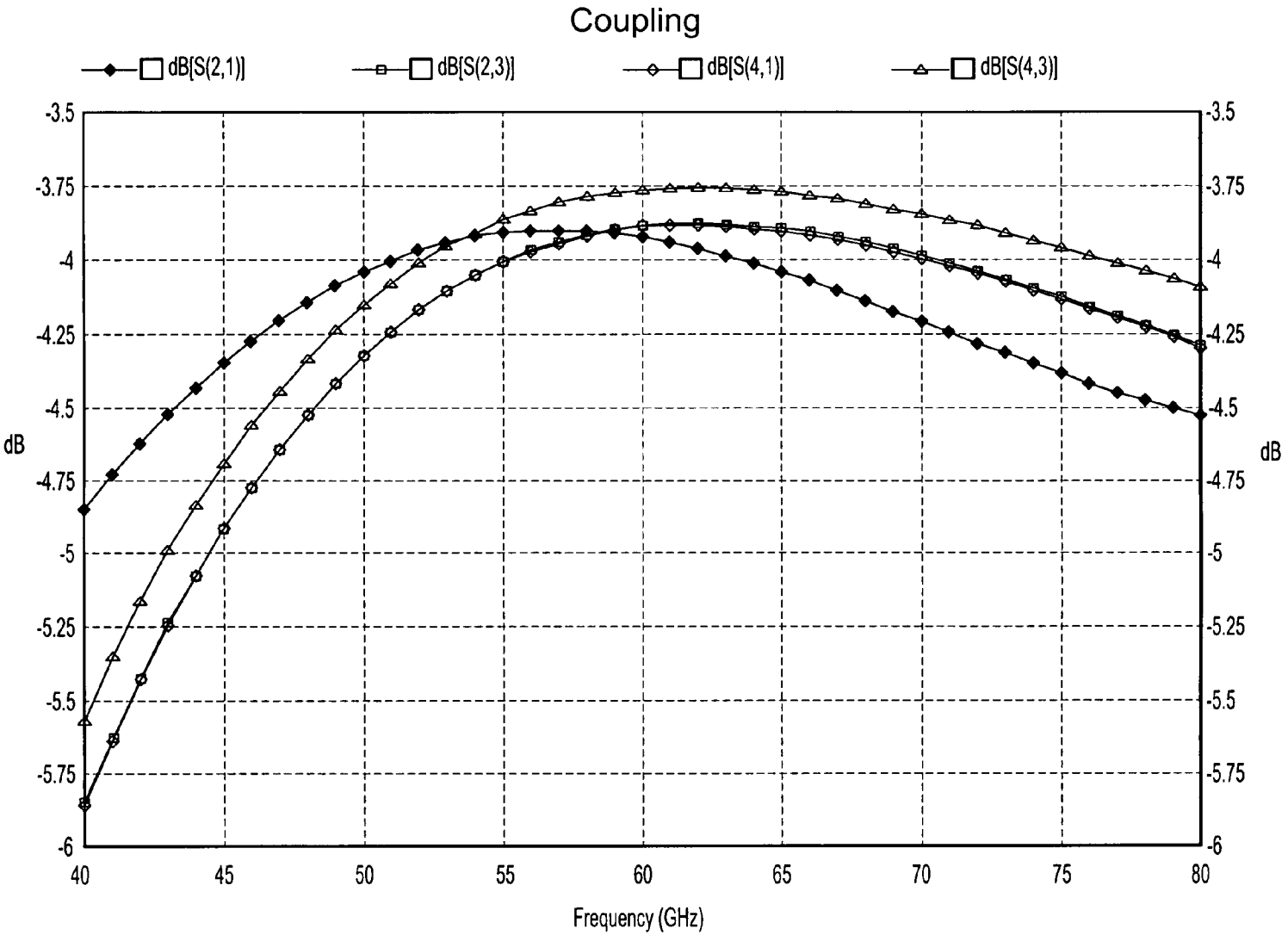
FIG. 7 is a graph illustrating a simulated coupling response of the ring hybrid of FIG. 6.

FIG. 7 illustrates simulated coupling responses of the ring hybrid of 610 from port Δ to P and N and Σ to P and N (i.e., $S_{21}$, $S_{41}$, $S_{23}$, and $S_{43}$). As shown in FIG. 7, coupling values of roughly −3.8 dB are observed. An ideal ring hybrid would have coupling values of −3 dB for an equal power split. Thus, the simulation shows an additional 0.8 dB of insertion loss due to the loss along an FGCPW. Although this loss is typical in silicon-based technology with aluminum metallization, other technologies such as gallium-arsenide or indium-phosphide, could realize lower insertion losses due to the use of different materials or geometries. Even so, a coupling value of −3.8 dB is useful for a variety of applications such as balanced amplification and mixing.

Figure 8A:
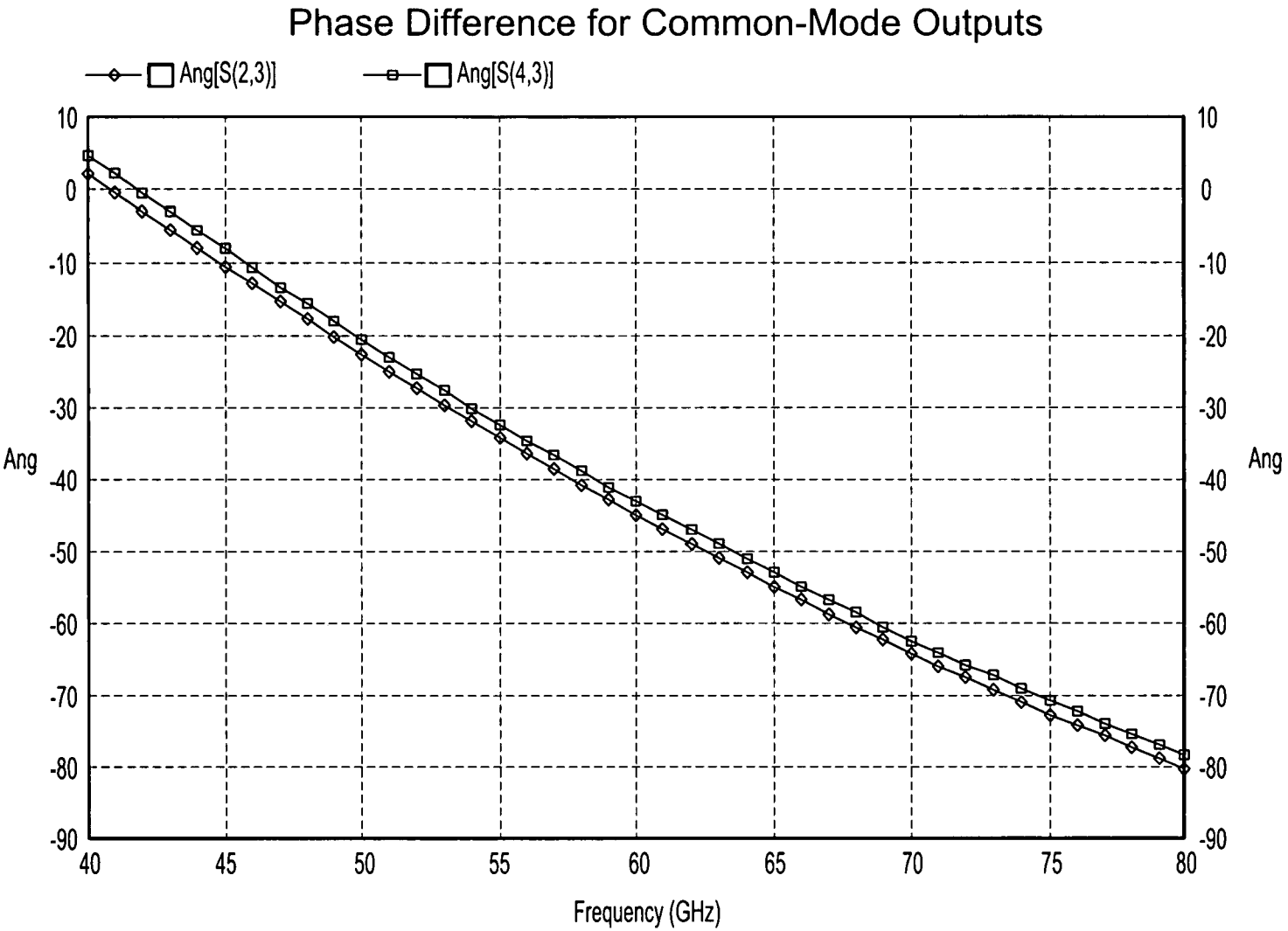
FIG. 8A is a graph illustrating a simulated phase difference for common-mode outputs of the ring-hybrid of FIG. 6.
Figure 8B:
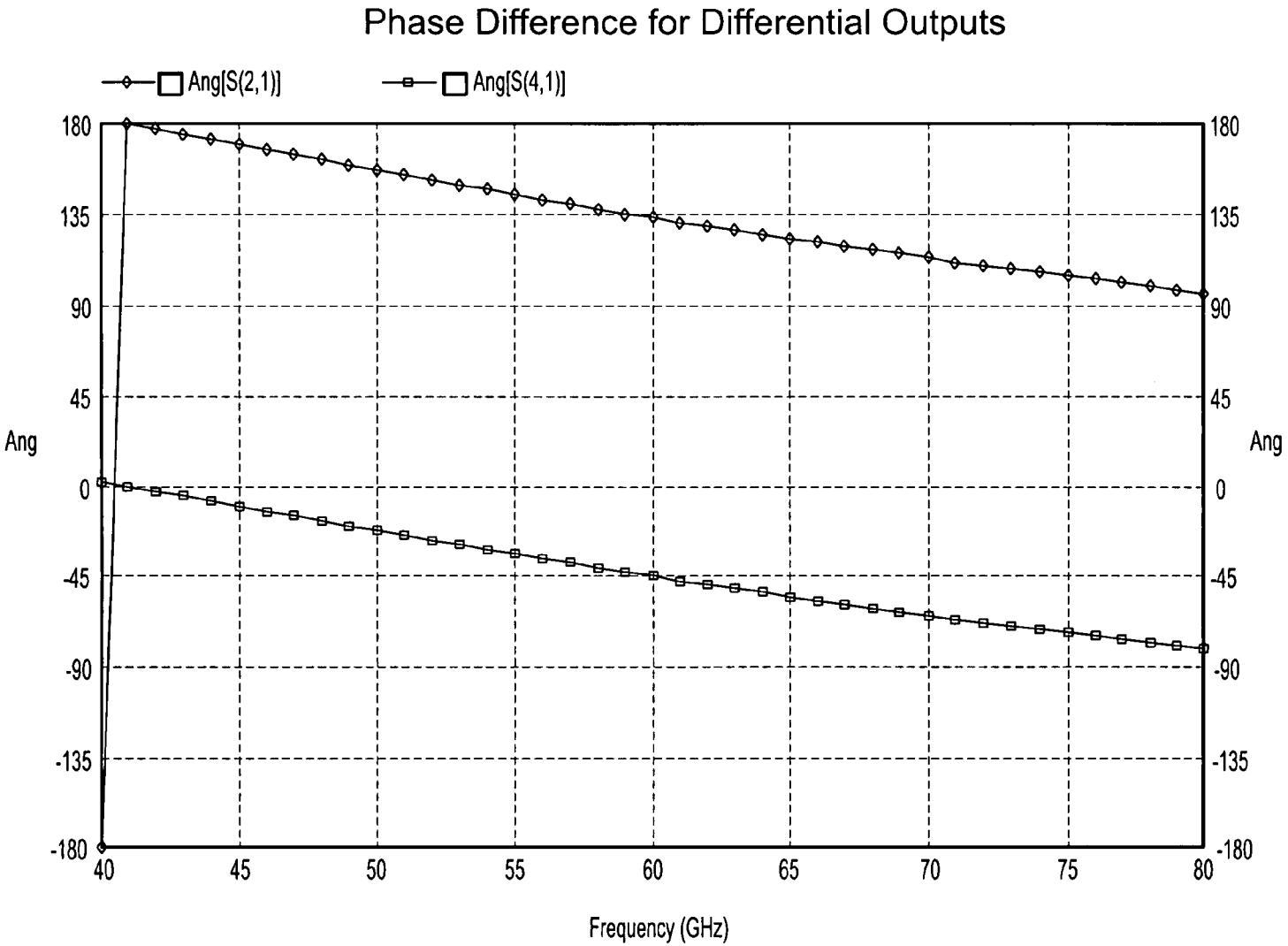
FIG. 8B is a graph illustrating a simulated phase difference for differential outputs of the ring hybrid of FIG. 6.

FIGS. 8A and 8B respectively illustrate simulated phase responses for P and N output signals of the P and N ports when driven by common-mode (S) and differential-mode (D) input signals. In particular, FIG. 8A shows that the P and N output signals are in phase when the ring hybrid 610 is driven by a common-mode input signal and FIG. 8B shows that the P and N output signals are 180-degrees out of phase when the ring hybrid 610 is driven with a differential-mode input signal. These observations confirm proper operation of the ring hybrid 610.

Figure 9:
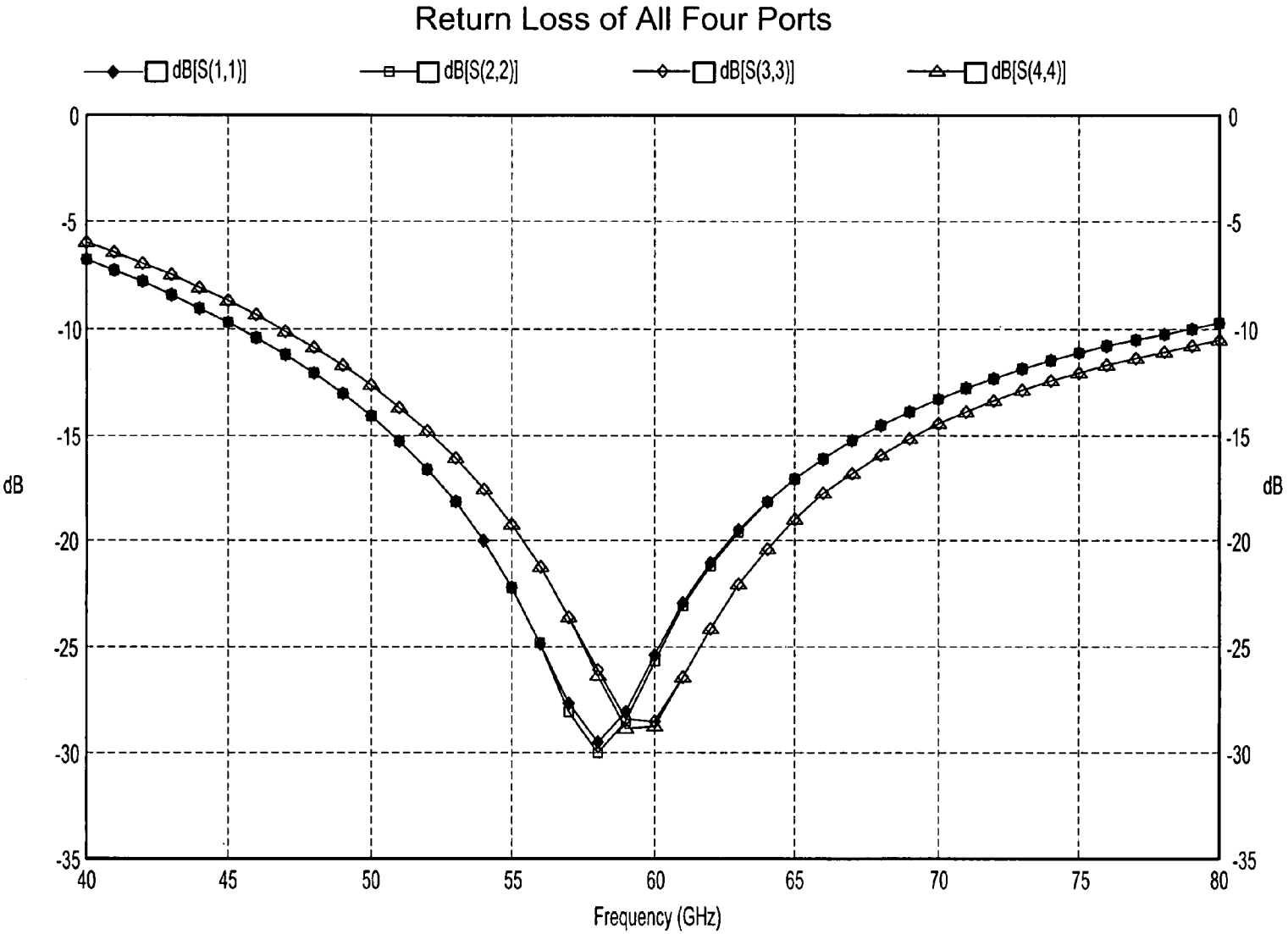
FIG. 9 is a graph illustrating a simulated return loss for all ports of the ring hybrid of FIG. 6.
Figure 10:
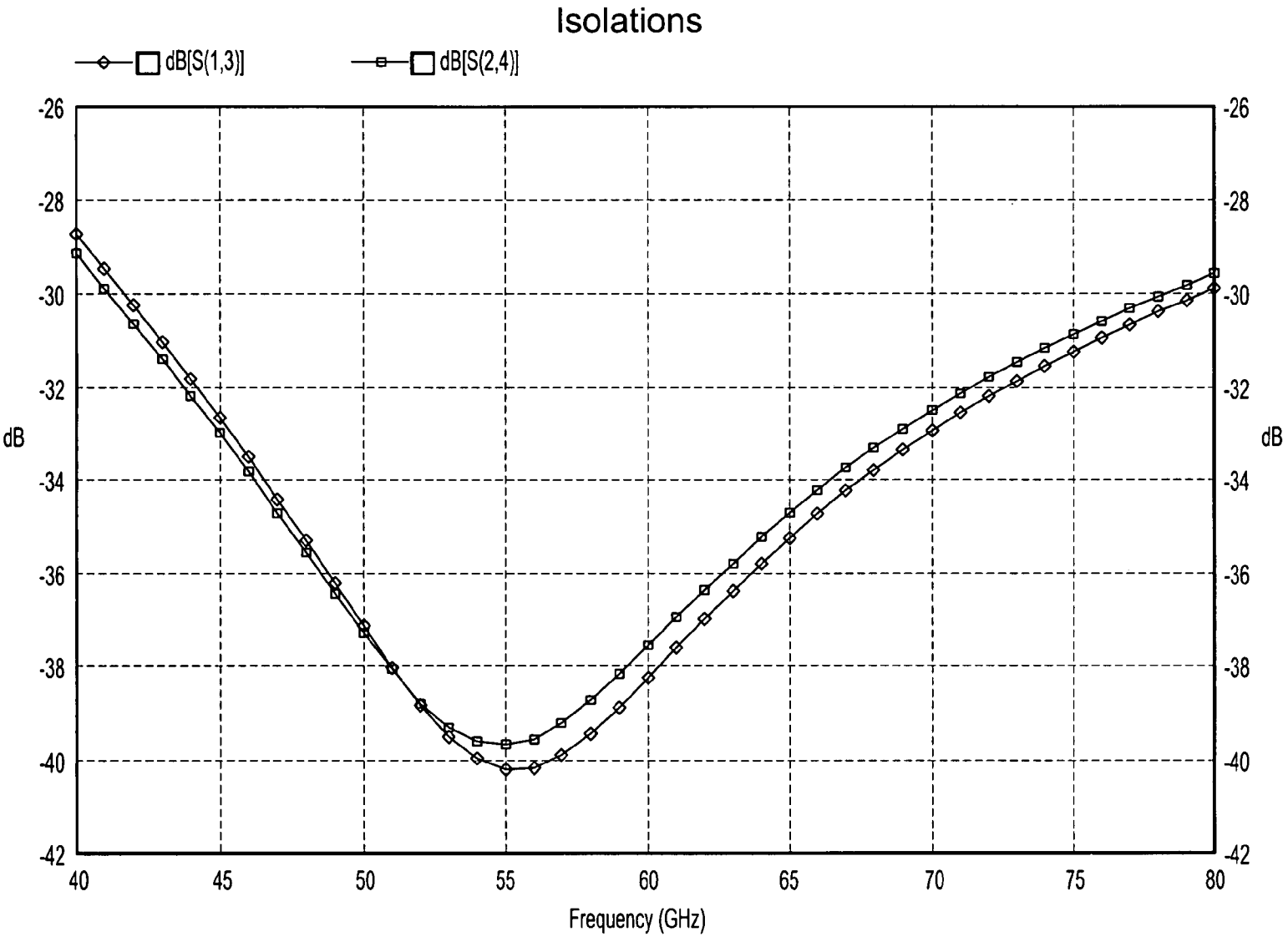
FIG. 10 is a graph illustrating simulated isolations of the ring hybrid of FIG. 6.

FIG. 9 illustrates simulated return losses for the ports 630-1–4 of the ring hybrid 610 when using a reference impedance of 50 ohms. As shown in FIG. 9, the ports 630-1–4 are well matched at 50 ohms. FIG. 10 illustrates simulated isolations for the ring hybrid 610. As shown in FIG. 10 the simulated isolations show the ring hybrid's 610 isolation higher than 30 dB.

FIG. 11 illustrates the simulations from FIGS. 7, 9 and 10 in table format. As shown in FIG. 11, by inserting DC blocking capacitors 240*a–d* into the phase inverter 210, there is minimal to no impact on the RF performance of the ring hybrid 610. In addition, the phase inverter 210 functions to provide DC isolation between ground 220*a–d* and the ports 630-1–4. Thus, by using the DC isolated phase inverter 210, the size of a ring hybrid coupler may be significantly reduced. Further, because the DC isolated phase inverter 210 restores the DC operation of the common-mode port on the ring hybrid 610, the ports 630-1–4 of the ring hybrid 610 may keep the common-mode potential applied to port Σ.

It should be understood that the above description is only representative of illustrative embodiments. For the convenience of the reader, the above description has focused on a representative sample of possible embodiments, a sample that is illustrative of the principles of the invention. The description has not attempted to exhaustively enumerate all possible variations. That alternative embodiments may not have been presented for a specific portion of the invention, or that further undescribed alternatives may be available for a portion, is not to be considered a disclaimer of those alternate embodiments. Other applications and embodiments can be implemented without departing from the spirit and scope of the present invention.

It is therefore intended, that the invention not be limited to the specifically described embodiments, because numerous permutations and combinations of the above and implementations involving non-inventive substitutions for the above can be created, but the invention is to be defined in accordance with the claims that follow. It can be appreciated that many of those undescribed embodiments are within the literal scope of the following claims, and that others are equivalent.

What is claimed is:

1. A direct current (DC) phase inverter, comprising:

a transmission line comprising a plurality of signal and ground traces, wherein the plurality of signal and ground traces are interchanged; and a plurality of capacitors disposed in series with the plurality of ground traces, wherein the plurality of capacitors isolate the DC phase inverter from a device connected to the transmission line.

2. The DC phase inverter of claim 1, wherein the transmission line is one of a finite-ground coplanar waveguide (FGCPW), coplanar waveguide, coplanar stripline, microstrip and slotline.

3. The DC phase inverter of claim 1, wherein the transmission line is capable of one of millimeter wave transmission and microwave transmission.

4. The DC phase inverter of claim 1, wherein the plurality of capacitors are one of metal-insulator-metal (MIM) capacitors, vertical parallel-plate capacitors, fringe capacitors, polysilicon capacitors and metal-oxide semiconductor (MOS) capacitors.

5. The DC phase inverter of claim 1, wherein the device is one of an amplifier, mixer, voltage-controlled oscillator (VCO), filter, frequency divider, frequency multiplier, limiter and hybrid coupler.

6. The DC phase inverter of claim 1, wherein the plurality of signal traces comprise:

an input signal trace and phase-inverted signal trace.

7. The DC phase inverter of claim 6, wherein a signal input via the input signal trace is shifted 180-degrees and output via the phase-inverted signal trace.

8. A ring hybrid coupler, comprising:

a first, second, third and fourth transmission line arm;

a first port connected to the first arm, second port connected to the second arm, third port connected to the third arm and fourth port connected to the fourth arm; and a direct current (DC) phase inverter inserted within one of the first, second, third and fourth arms, wherein the DC phase inverter comprises:

a transmission line comprising a plurality of signal and ground traces, wherein the plurality of signal and ground traces are interchanged; and a plurality of capacitors disposed in series with the plurality of ground traces, wherein the plurality of capacitors isolate the DC phase inverter from a device connected to the transmission line.

9. The ring hybrid coupler of claim 8, wherein the first, second, third and fourth transmission line arms have equal lengths, wherein the lengths of the first, second, third and fourth transmission lines are 50 μm to 10 mm.

10. The ring hybrid coupler of claim 8, wherein impedance of one of the first, second, third and fourth transmission line arms is determined by:

$$Z=Zo./2(1-\cot^2\theta)]^{0.5}$$

where Z is the impedance of one of the first, second, third and fourth transmission line arms and Zo is impedance of one the first, second, third and fourth ports.

11. The ring hybrid coupler of claim 8, wherein the DC phase inverter performs a 180-degree phase shift through the interchange between the signal and ground traces.

12. The ring hybrid coupler of claim 8, wherein one of the first, second, third and fourth ports is a common-mode port.

13. The ring hybrid coupler of claim 12, wherein the DC isolated phase inverter is inserted within one of the first, second, third and fourth arms not adjacent to the common-mode port.

14. The ring hybrid coupler of claim 12, wherein the DC isolated phase inverter restores DC operation of the common-mode port while leaving the remaining ports at a common-mode potential applied to the common-mode port.

15. The ring hybrid coupler of claim 8, wherein the transmission line of the DC phase inverter is one of a finite-ground coplanar waveguide (FGCPW), coplanar waveguide, coplanar stripline, microstrip and slotline.

16. The ring hybrid coupler of claim 8, wherein the transmission line of the DC phase inverter is capable of one of millimeter wave transmission and microwave transmission.

17. The ring hybrid coupler of claim 8, wherein the capacitors of the DC phase inverter are one of metal-insulator-metal (MIM) capacitors, vertical parallel-plate capacitors, fringe capacitors, polysilicon capacitors and metal-oxide semiconductor (MOS) capacitors.

18. The ring hybrid coupler of claim 8, wherein the device connected to the DC phase inverter is one of an amplifier, mixer, voltage-controlled oscillator (VCO), filter, frequency divider, frequency multiplier, limiter and hybrid coupler.

19. The ring hybrid coupler of claim 8, wherein the plurality of signal traces of the DC phase inverter comprise:

an input signal trace and phase-inverted signal trace.

20. The ring hybrid coupler of claim 19, wherein a signal input via the input signal trance is shifted 180-degrees and output via the phase-inverted trace.

21. A method for isolating a direct current (DC) phase inverter, comprising:

interchanging a plurality of signal and ground traces on a transmission line of the DC phase inverter; and isolating the DC phase inverter from a device connected to the transmission line by inserting a plurality of capacitors in series with the plurality of ground traces.

22. The method of claim 21, wherein a signal input via an input signal trace of the plurality of signal traces is shifted 180-degrees and output via a phase-inverted signal trace of the plurality of signal traces.

23. The method of claim 21, further comprising:

inserting the DC phase inverter into an arm of a ring hybrid coupler.

24. The method of claim 23, further comprising:

restoring DC operation of a common-mode port of the ring hybrid coupler while leaving remaining ports of the ring hybrid coupler at a common-mode potential applied to the common-mode port.

* * * * *